US008934649B1

(12) United States Patent
Lee et al.

(10) Patent No.: US 8,934,649 B1
(45) Date of Patent: Jan. 13, 2015

(54) MICRO ELECTRO-MECHANICAL SYSTEM (MEMS) MICROPHONE DEVICE WITH MULTI-SENSITIVITY OUTPUTS AND CIRCUIT WITH THE MEMS DEVICE

(71) Applicant: Solid State System Co., Ltd., Hsinchu (TW)

(72) Inventors: Chien-Hsing Lee, Hsinchu County (TW); Tsung-Min Hsieh, New Taipei (TW); Jhyy-Cheng Liou, Hsinchu County (TW)

(73) Assignee: Solid State System Co., Ltd., Hsinchu (TW)

( * ) Notice: Subject to any disclaimer, the term of this patent is extended or adjusted under 35 U.S.C. 154(b) by 0 days.

(21) Appl. No.: 14/013,049

(22) Filed: Aug. 29, 2013

(51) Int. Cl.
*H04R 25/00* (2006.01)
*H04R 17/02* (2006.01)
*H04R 3/00* (2006.01)

(52) U.S. Cl.
CPC . *H04R 17/02* (2013.01); *H04R 3/00* (2013.01)
USPC ..... 381/174; 381/175

(58) Field of Classification Search
CPC ..... H04R 3/00; H04R 17/02; H04R 23/006
USPC ..... 381/174, 175, 191, 355, 361; 257/415, 257/416; 438/53
See application file for complete search history.

(56) References Cited

U.S. PATENT DOCUMENTS

| | | | | |
|---|---|---|---|---|
| 2007/0047746 | A1 | 3/2007 | Weigold et al. | |
| 2008/0219474 | A1 * | 9/2008 | Deruginsky et al. | 381/111 |
| 2010/0183167 | A1 | 7/2010 | Phelps et al. | |
| 2011/0075865 | A1 * | 3/2011 | Yang et al. | 381/174 |
| 2013/0065343 | A1 * | 3/2013 | Yang et al. | 438/53 |
| 2013/0264663 | A1 * | 10/2013 | Dehe et al. | 257/416 |

* cited by examiner

*Primary Examiner* — Tuan D Nguyen
(74) *Attorney, Agent, or Firm* — Jianq Chyun IP Office

(57) ABSTRACT

A MEMS device includes substrate having a cavity. A dielectric layer is disposed on a second side of substrate at periphery of the cavity. A backplate structure is formed with the dielectric layer on a first side of the substrate and exposed by the cavity. The backplate structure includes at least a first backplate and a second backplate. The first backplate and the second backplate are electric disconnected and have venting holes to connect the cavity and the chamber. A diaphragm is disposed above the backplate structure by a distance, so as to form a chamber between the backplate structure and the diaphragm. A periphery of the diaphragm is embedded in the dielectric layer. The diaphragm serves as a common electrode. The first backplate and the second backplate respectively serve as a first electrode unit and a second electrode unit in conjugation with the diaphragm to form separate two capacitors.

20 Claims, 9 Drawing Sheets

MICRO ELECTRO-MECHANICAL SYSTEM (MEMS) MICROPHONE DEVICE WITH MULTI-SENSITIVITY OUTPUTS AND CIRCUIT WITH THE MEMS DEVICE

BACKGROUND OF THE INVENTION

1. Field of Invention

The present invention relates to micro electro-mechanical system (MEMS) device. More particularly, the present invention relates to MEMS microphone device with multi-sensitivity outputs.

2. Description of Related Art

MEMS device, such as MEMS microphone or the like device, is formed based on semiconductor fabrication process. As a result, the MEMS microphone or MEMS device can be in rather small size and can be implemented into various larger systems to sense the environmental signals, such as acoustic signal or acceleration signal.

The sensing mechanism of the MEMS device is based on a diaphragm, which can vibrate in responding to acoustic pressure or in responding to any factor, such as accelerating force, capable of causing deformation of the diaphragm. Due to the vibration or displacement of the diaphragm, the capacitance is changed, so as to be converted into electric signals used in subsequent application circuits.

Conventionally, one MEMS device has its own designed sensitivity. However, when the application system needs multiple sensitivities of the MEMS to meet the changing environmental condition, the conventional way may need to implement multiple MEMS devices with different sensitivities, so as to choose one of the multiple MEMS devices in use. This manner would at least cause a larger circuit cost.

SUMMARY OF THE INVENTION

A MEMS device can use a common diaphragm to form at least two sensing capacitors in a single MEMS device.

A MEMS device, according to exemplary embodiments, includes a substrate having a first side and a second side, wherein a cavity is formed at the second side. A dielectric layer is disposed on the second side of the substrate at a periphery of the cavity. A backplate structure is formed with the dielectric layer on the first side of the substrate and exposed by the cavity. The backplate structure includes at least a first backplate and a second backplate. The first backplate and the second backplate are electric disconnected and have venting holes to connect the cavity and the chamber. A diaphragm is disposed above the backplate structure by a distance, so as to form a chamber between the backplate structure and the diaphragm. A periphery of the diaphragm is embedded in the dielectric layer. The diaphragm serves as a common electrode. The first backplate and the second backplate respectively serve as a first electrode unit and a second electrode unit in conjugation with the diaphragm to form separate two capacitors.

The invention also provides a micro electro-mechanical system (MEMS) circuit, including a MEMS device as described above. A first voltage source is coupled to the first electrode unit of the first backplate in the MEMS device. A second voltage source is coupled to the second electrode unit of the second backplate in the MEMS device. An amplifying circuit is to amplify a first sensing signal at the first electrode unit and a second sensing signal at the second electrode unit.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

A MEMS device with multiple sensitivities is disclosed, in which a single diaphragm is commonly used for different sensitivities. The MEMS device can use a common diaphragm to form at least two sensing capacitors in a single MEMS device.

Multiple embodiments are provided for describing the invention. However, the invention is not limited to the disclosed embodiments. Further, at least two of the embodiments may allow a proper combination to have other embodiments.

Figure 1:
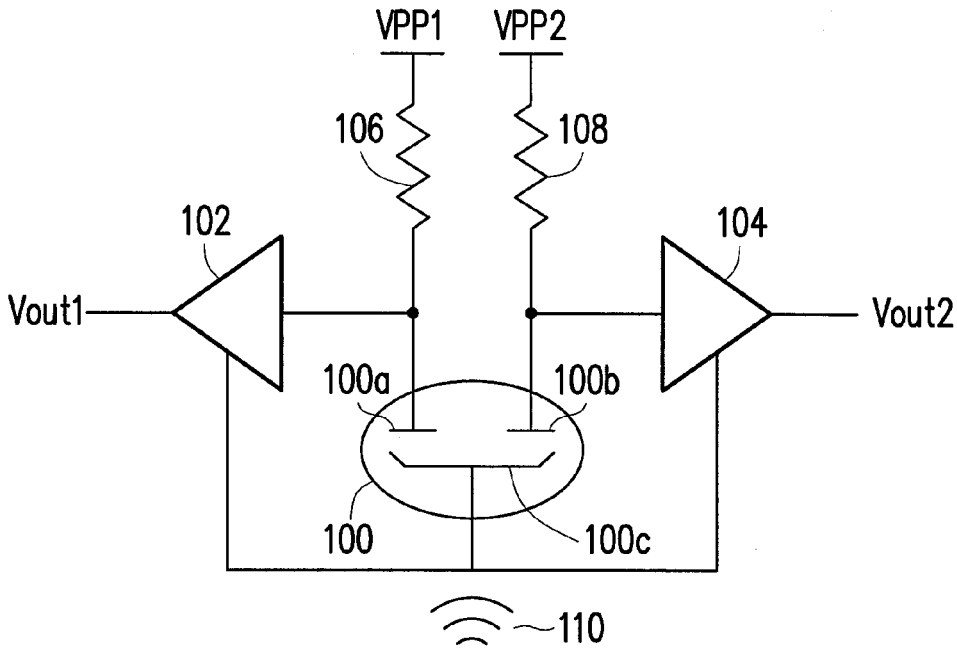
FIG. 1 is a MEMS circuit according to an embodiment of the invention.

FIG. 1 is a MEMS circuit according to an embodiment of the invention. In FIG. 1, a MEMS device 100 with multiple sensitivities is provided. With the common diaphragm 100*c*, multiple backplates, such as a first backplate 100*a* and a second backplate 100*b*, are formed in a single MEMS device 100 and thereby form at least two capacitors. The variances of the capacitances of the two capacitors formed with the same diaphragm 100*c* generate two sensing signals, separately.

A first voltage source, VPP1, is coupled to an electrode of the first backplate 100*a* in the MEMS device 100 through a resistor 106, in an example. Likewise, a second voltage source, VPP2, is coupled to the electrode of the second backplate 100*b* in the MEMS device 100 through a resistor 108, in an example.

Generally, an amplifying circuit is to amplify a first sensing signal at the electrode of the first backplate 100*a* and a second sensing signal at the electrode of the second backplate 100*b*.

In the example of FIG. 1, the amplifying circuit can include a first operational amplifier (OP1) 102 and a second operational amplifier (OP2) 104. The OP1 is coupled to the electrode of the first backplate to amplify the first sensing signal. The second operational amplifier is coupled to the electrode of the second backplate to amplify the second sensing signal. The first operation amplifier 102 and the second operation amplifier 104 have same amplification gain or different amplification gain.

The mechanism of sensitivity is following. The first operation amplifier 102 with an amplification gain, Gain_1, outputs a first output signal, Vout1. Likewise, the second operation amplifier 104 with an amplification gain, Gain_2, outputs a second output signal, Vout2. The sensitivity of the output signals Vout1 and Vout2 are expressed in Eq. (1) and Eq. (2) as follows:

$$\text{Sensitivity } Vout1 = \frac{\Delta X1}{D1} \times Vpp1 \times \text{Gain_1}. \quad (1)$$

$$\text{Sensitivity } Vout2 = \frac{\Delta X2}{D2} \times Vpp2 \times \text{Gain_2}. \quad (2)$$

The capacitance of the capacitor is inverse proportional to the distance between the diaphragm 100*c* and the backplate 100*a* or the backplate 100*b*, denoted by D1 and D2 for air gap, respectively. ΔX1 and ΔX2 are diaphragm deformations at the two capacitors caused by environment factors, such as the acoustic pressure 110, resulting in different capacitance.

In general properties, ΔX1 and ΔX2 are dependent on the K, elastic constant of diaphragm. Vpp1 and Vpp2 are the applied voltages on MEMS capacitors. So, the any of the four parameters of ΔX, D, $V_{pp}$ and Gain, omitting the index of 1 and 2, can be taken in consideration for change to have different sensitivities. Multiple embodiments are to be described later.

Figure 2:
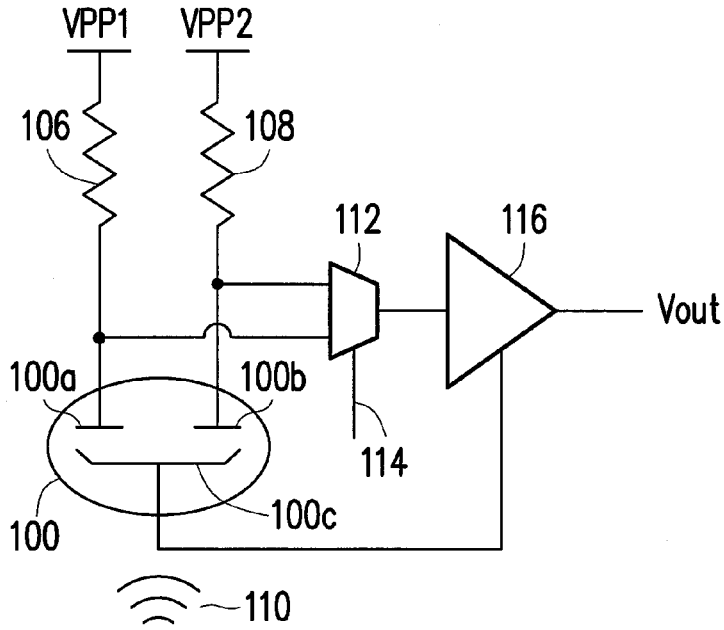
FIG. 2 is another MEMS circuit according to an embodiment of the invention.

FIG. 2 is another MEMS circuit according to an embodiment of the invention. In FIG. 2, the MEMS circuit is FIG. 1 can be modified by using one multiplexer 112 and one operational amplifier 116. The multiplexer 112 receives a first sensing signal from the electrode of the first backplate 100*a* and a second sensing signal from the electrode from the second backplate 100*b*, and select one of the first sensing signal and the second sensing signal as an output signal, according to a selection signal 114. An operational amplifier amplifies the output signal of the multiplexer 112.

Figure 3A:
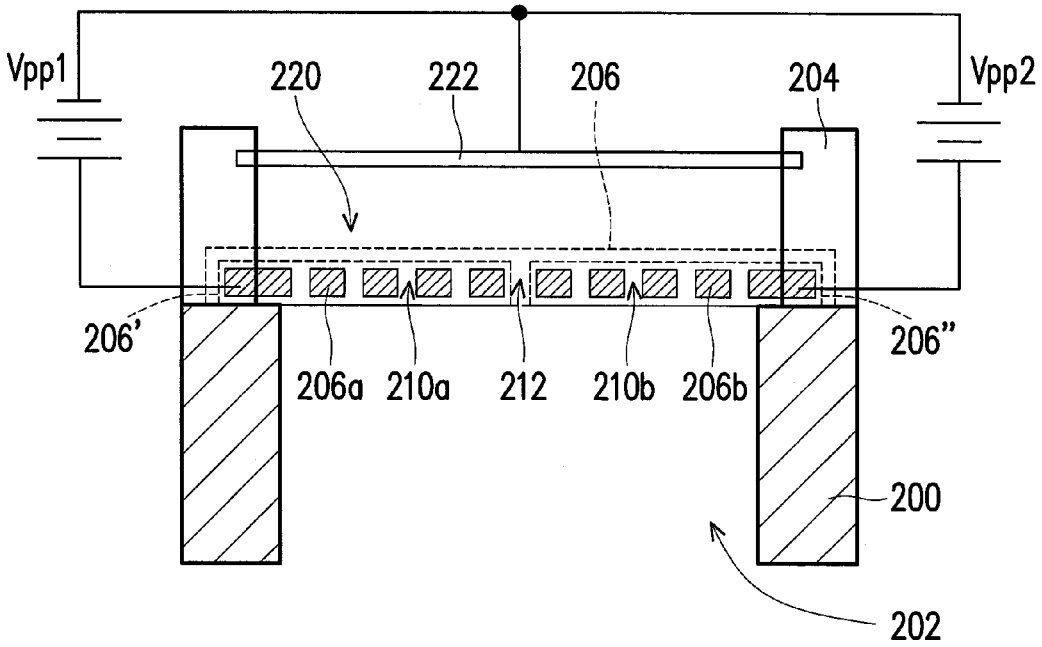
FIGS. 3A-3B are cross-sectional view and top perspective view of a MEMS device, according to an embodiment of the invention.
Figure 3B:
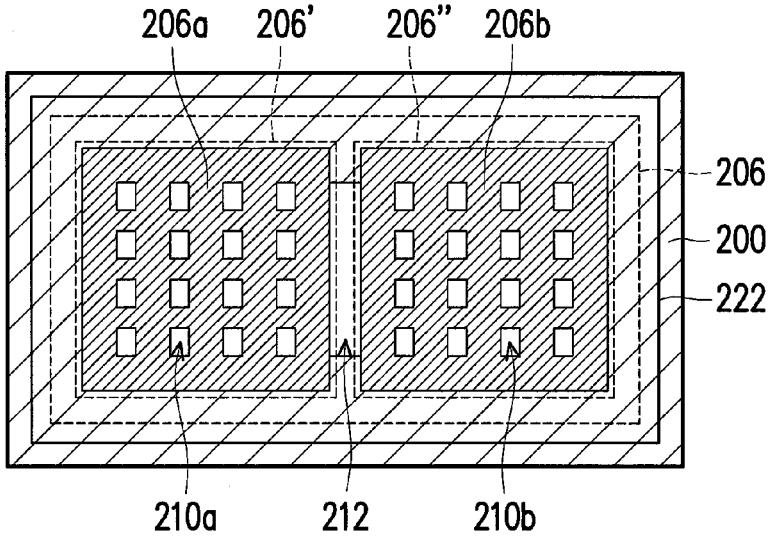

FIGS. 3A-3B are cross-sectional view and top perspective view of a MEMS device, according to an embodiment of the invention. In FIG. 3A and FIG. 3B, a MEMS device, according to exemplary embodiments, includes a substrate 200 having a first side and a second side, wherein a cavity 202 is formed at the second side of the substrate 200. Two capacitors as described in FIG. 1 or FIG. 2 are taken as the example. However, in the same aspect, more capacitor can be implemented if the MEMS is desired to have more levels of sensitivity. A dielectric layer 204 is disposed on the second side of the substrate 200 at a periphery of the cavity 202. A backplate structure 206 is formed with the dielectric layer 204 on the first side of the substrate 200 and exposed by the cavity 202. The backplate structure 206 in rigid structure includes at least a first backplate 206*a* included in a first electrode unit 206' and a second backplate 206*b* included in a second backplate unit 206". The first backplate 206*a* and the second backplate 206*b* are respectively equivalent to the first backplate 100*a* and the second backplate 100*b* shown in FIGS. 1-2.

The first backplate 206*a* and the second backplate 206*b* are electric disconnected, such as separation by a gap 212. Each of the first backplate 206*a* and the second backplate 206*b* respectively has venting holes 210*a*, 210*b* to connect the cavity 202 and the chamber 220. The venting holes 210*a* are included in the first backplate 206*a* and the venting holes 210*b* are included in the second backplate 206*b*. In this example, the first backplate 206*a* and the second backplate 206*b* are conductive, such as the polysilicon layer, so the electric disconnection is necessary to form separate capacitors. A diaphragm 222 is disposed above the backplate structure 206 by a distance, so as to form a chamber 220 between the backplate structure 206 and the diaphragm 222. A periphery of the diaphragm 222 is embedded in the dielectric layer 204. The diaphragm 222 is conductive and serves as a common electrode in an embodiment. The first backplate 206*a* of the first electrode unit 206' and the second backplate 206*b* of the second electrode unit 206" respectively sever as two electrodes in conjugation with the diaphragm 222, as a common electrode, to form separate two capacitors.

It can be noted that the fabrication of MEMS device is based on the semiconductor fabrication process. In order to form the backplate structure 206 and the diaphragm 222, the dielectric layer 204 includes several sub layers and then re removed at the central region to form the chamber 220. The fabrication of the backplate structure 206 and the diaphragm 222 can be understood by the one with ordinary skill in the art. The backplate structure 206 indicated by dashed is just to express the portion of the backplate structure 206 of the whole structure of the MEMS device. Even further, the backplate structure 206 may also include a portion of the substrate 200 at the second side, not shown in drawings but known in the art. The structure in detail of the backplate structure 206 and the diaphragm 222 are not limited to the examples of drawings. However, multiple sub backplates are actually involved in fabrication processes to conjugate with the single diaphragm to form multiple capacitors with different sensitivities. Further, each of the backplates and the diaphragm 222 may also include the dielectric layer therein during fabrication. However, with respect to MEMS device, the function of the diaphragm 222 also serves as common electrode and the function of the first backplate 206*a* and the second backplate 206*b* also serve as two separate electrodes, which can be applied with different operation voltages.

Based on the structure described above, the operation can implement two operation voltages Vpp1 and Vpp2. In the example, the diaphragm 222 can be a cathode or the common ground voltage. The voltages Vpp1 and Vpp2 are respectively applied to the first backplate 206*a* of the first electrode unit and the second backplate 206*b* of the second electrode unit, which are conductive material, such polysilicon, in this example. The first backplate 206*a* and the second backplate 206*b* respectively form with the diaphragm 222 as two capacitors. According to the relation of Eq. (1) and Eq. (2), the two capacitors cause two different sensitivities.

It can be noted that the two first backplate 206*a* and the second backplate 206*b* are physically separated because the two first backplate 206*a* and the second backplate 206*b* are conductive and applied with different voltages. In alternative embodiments, the two first backplate 206*a* and the second backplate 206*b* can me modified under the same aspect.

Figure 4A:
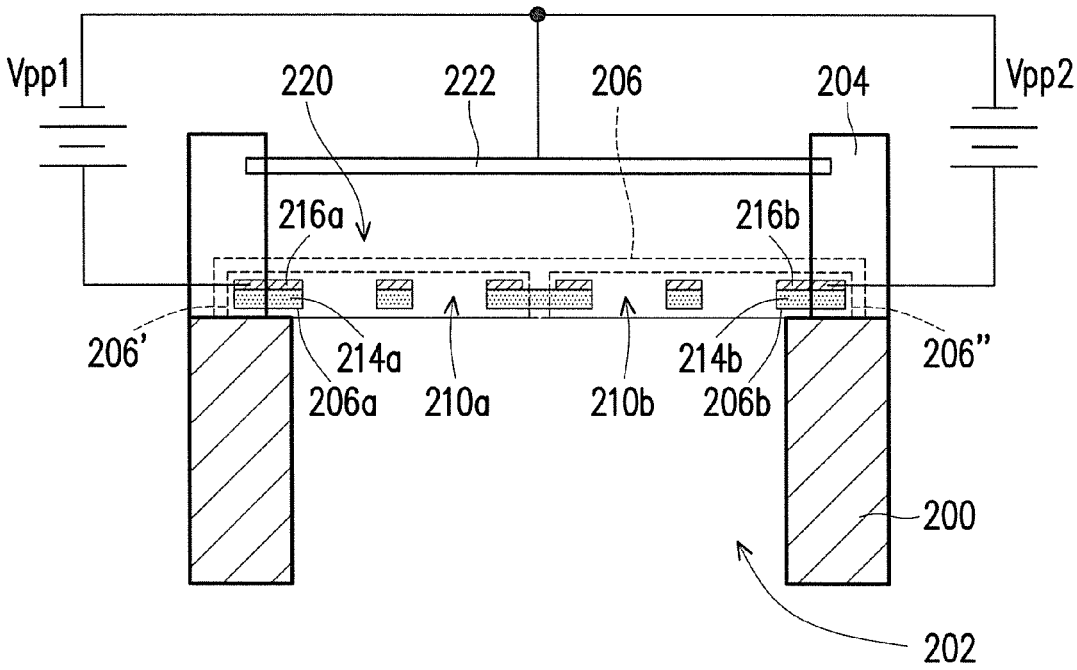
FIGS. 4A-4B are cross-sectional view and top perspective view of a MEMS device, according to an embodiment of the invention.
Figure 4B:
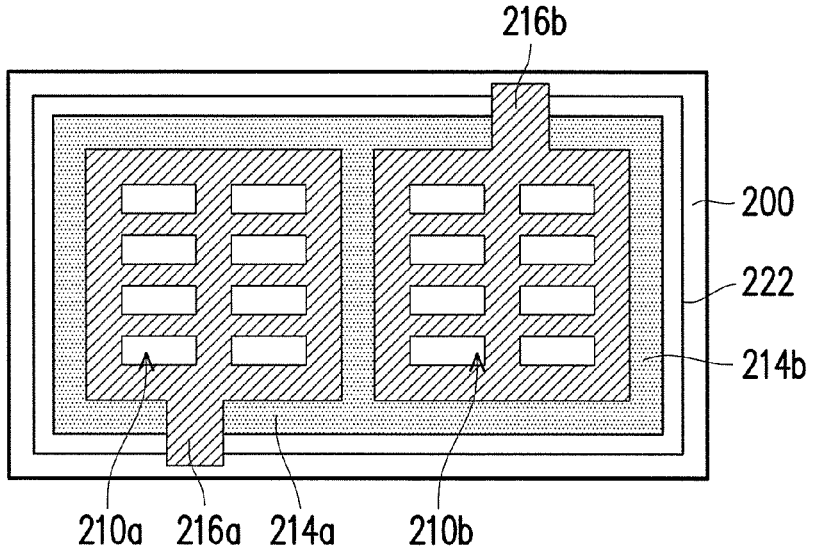

FIGS. 4A-4B are cross-sectional view and top perspective view of a MEMS device, according to an embodiment of the invention. In FIGS. 4A-4B, the two first backplate 206*a* and the second backplate 206*b* in FIGS. 3A-3B may be modified to include insulating layer and electrode layer. In an example referring to FIGS. 4A-4B, the backplate structure 206 also includes the first backplate 206*a* and the second backplate 206*b*. The first backplate 206*a* in the example may include a first dielectric layer 214*a* and a first electrode layer 216*a*. Likewise, the second backplate 206*b* also includes a second dielectric layer 214*b* and a second electrode layer 216*b*. However, the first dielectric layer 214*a* and the second dielectric layer 214*b* can be physically integrated as a single dielectric layer to provide the mechanical supporting strength. The first electrode layer 216*a* and the second electrode layer 216*b* are electrically separated to respectively serve as the first electrode and the second electrode for receiving the two operation voltages.

The other elements with same reference number are the same as those in FIGS. 3A-3B, and are not repeatedly described here and later descriptions.

Figure 5:
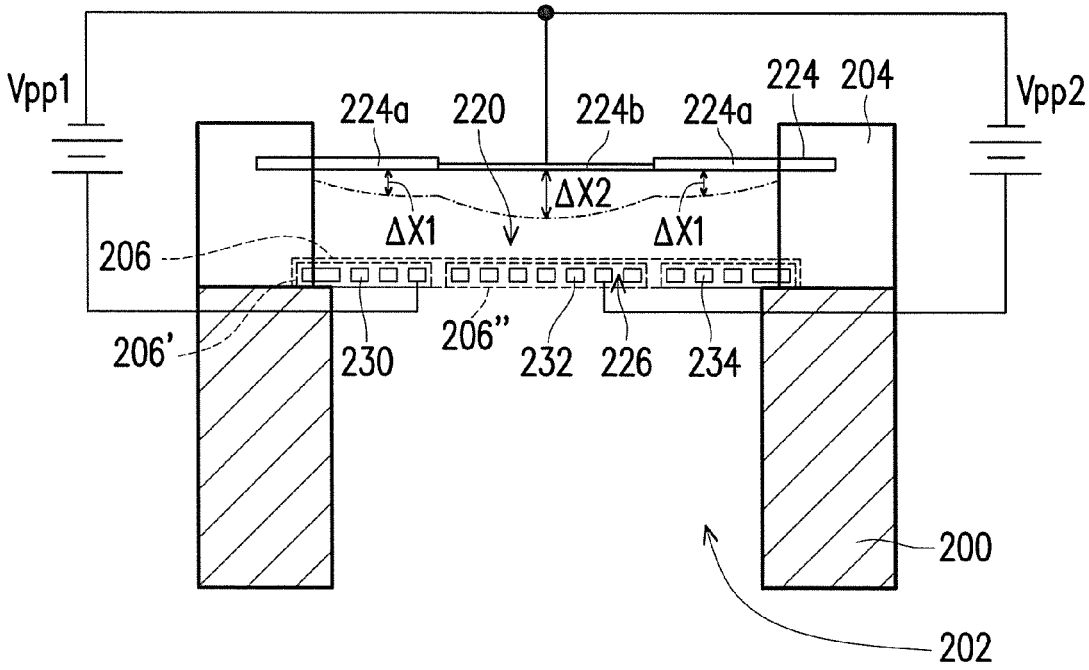
FIG. 5 is a cross-sectional view of a MEMS device, according to an embodiment of the invention.

Further, under the same aspect to form multiple capacitors based on the single diaphragm, other alternative embodiments are to be disclosed. FIG. 5 is a cross-sectional view of a MEMS device, according to an embodiment of the invention. Based on the relation in Eq. (1) and Eq. (2), the different sensitivities for the capacitors can also be achieved by the different elastic properties of the diaphragm, causing different ranges of displacements in the diaphragm. In FIG. 5, the diaphragm 224 can have multiple regions, such as the first diaphragm region 224*a* and the second diaphragm region 224*b*. The first diaphragm region 224*a* is usually at the peripheral region of the diaphragm, and the second diaphragm region 224*b* is at the central region covering the center of the diaphragm 224. However, the thickness of diaphragm 224 is not uniform. In general, the thickness at the second diaphragm region 224*b*, which may also be referred as the central region, is thinner than the thickness at the first diaphragm region 224*a*, which may also be referred as the peripheral region. As a result, the displacement of the diaphragm 224 at the first diaphragm region 224*a* is $\Delta X1$ and the displacement of the diaphragm 224 at the second diaphragm region 224*b* is $\Delta X2$, wherein $\Delta X2>\Delta X1$.

The backplate structure 206 may also include backplates 230 and 234, which are at the outer periphery of a backplate 232 at the central region. However, depending on the different geometrical configurations, the diaphragm can be disk-like or a rectangular-like.

Figure 6A:
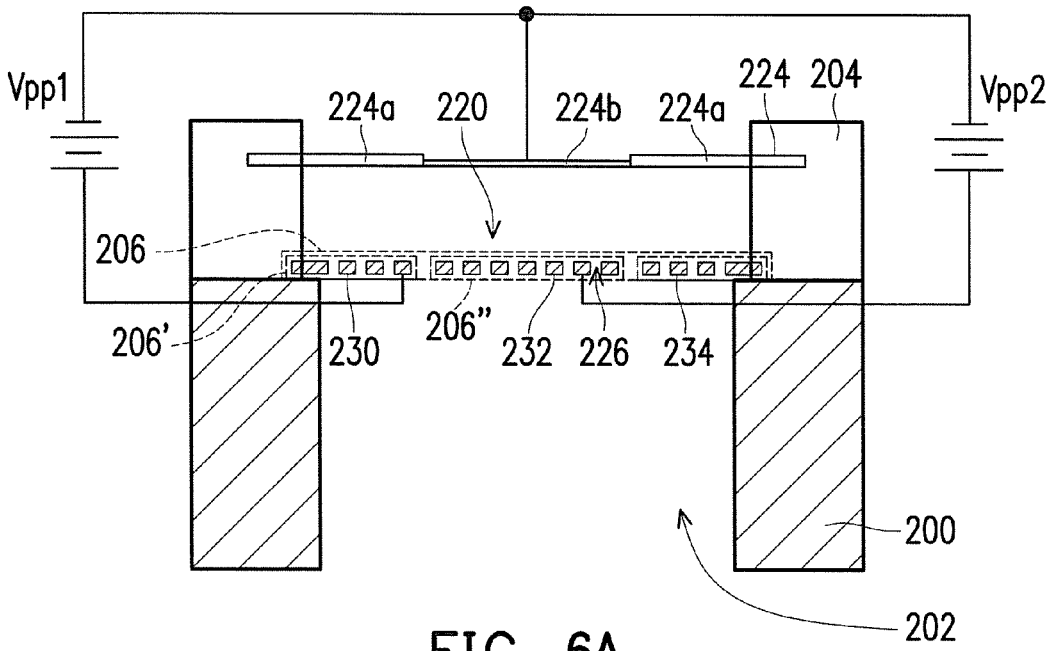
FIG. 6A-6B are cross-sectional view and top perspective view of a MEMS device, according to an embodiment of the invention.
Figure 6B:
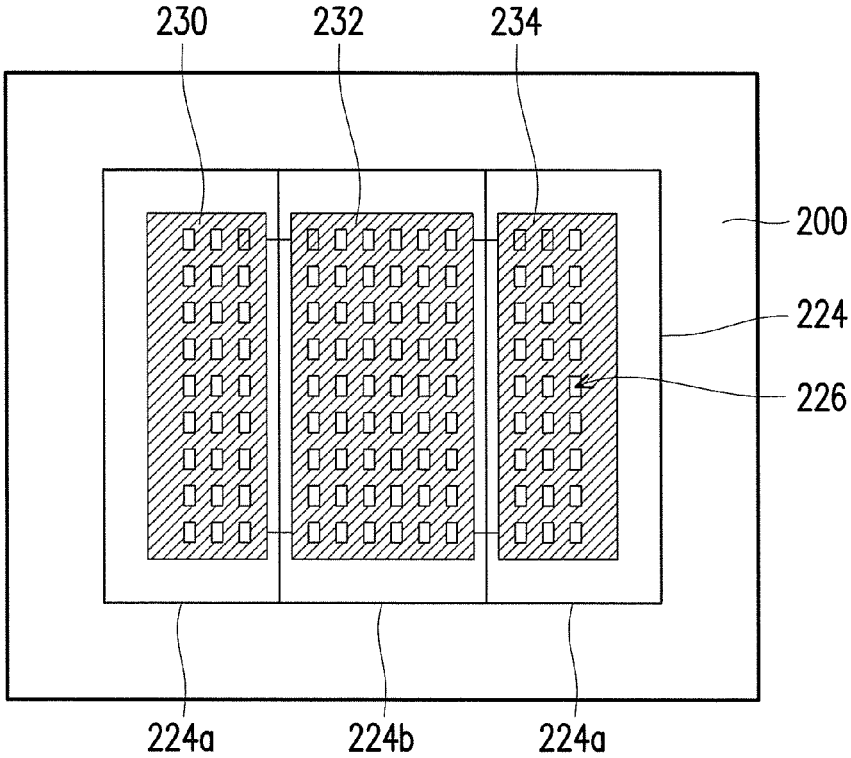

FIG. 6A-6B are cross-sectional view and top perspective view of a MEMS device, according to an embodiment of the invention. In the embodiment of FIGS. 6A-6B, the diaphragm 224 has the first diaphragm region 224*a* and the second diaphragm region 224*b*. The second diaphragm region 224*b* serves as the central region is sandwiched by the two peripheral regions of the first diaphragm region 224*a*. All of the two regions of the first diaphragm region 224*a* and the second diaphragm region 224*b* can be bar geometric shape. The second diaphragm region 224*b* is higher in elastic constant than the first diaphragm region 224*a*. For example, the second diaphragm region 224*b* is thinner than the first diaphragm region 224*a*. In circuit, the diaphragm 224 is also the common electrode.

The backplate structure 206 has three backplates 230, 232, 234 corresponding to the two regions of the first diaphragm regions 224*a* and the second diaphragm region 224*b*. The backplate 232 with the diaphragm 224 at the second diaphragm region 224*b* forms a capacitor in higher sensitivity. The backplate 230 and backplate 234 with the diaphragm 224 at the first diaphragm region 224*a* form another capacitor with lower sensitivity. In fabrication, the backplates 230 and the backplate 234 are conductive in this example and can be directly connected with the join structure or indirectly connected by the circuit to connect to the same voltage source of the operation voltage. In the example, the later situation is shown, so the backplate 230 and the backplate 234 are not directly joined. However, the backplate 232 should be electrically separated from the backplate 230 and the backplate 234 and is applied by another voltage source of the operation voltage. The venting holes 226 are like the venting holes 210*a* and 210*b* in FIG. 3A-3B to connect the chamber and the cavity 202.

Figure 7A:
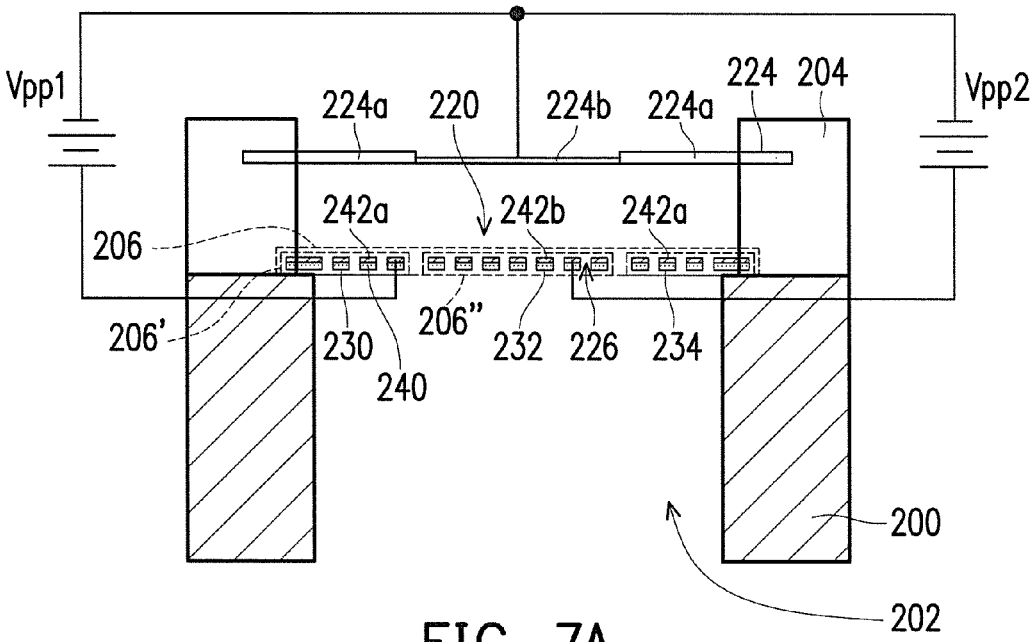
FIG. 7A-7B are cross-sectional view and top perspective view of a MEMS device, according to an embodiment of the invention.
Figure 7B:
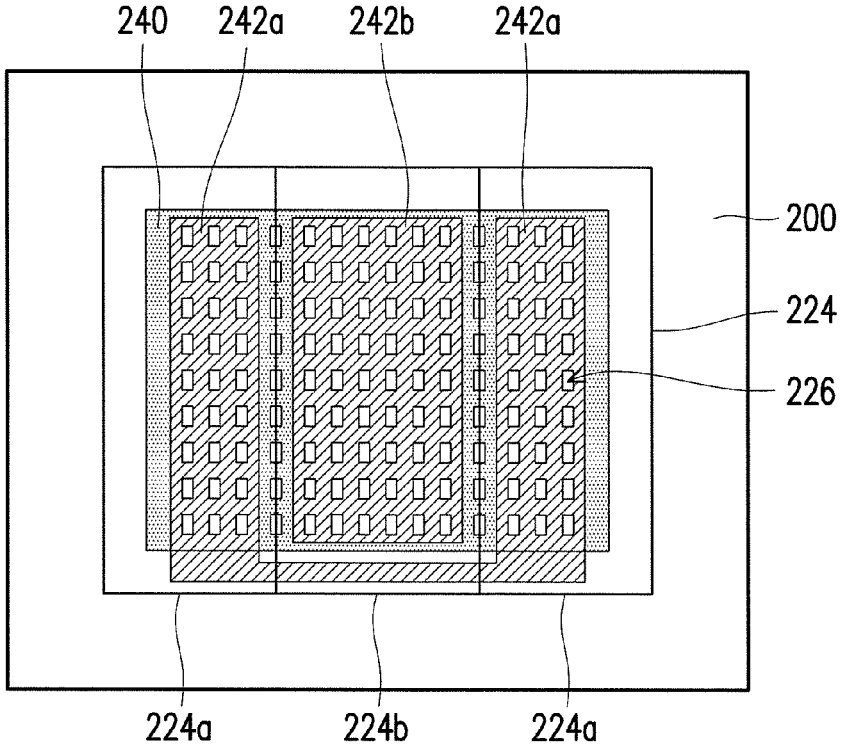

With the similar aspect in FIGS. 4A-4B with respect to FIGS. 3A-3B, the backplate structure 206 can be modified to include the common dielectric layer. Another embodiment is provided. FIG. 7A-7B are cross-sectional view and top perspective view of a MEMS device, according to an embodiment of the invention.

In FIGS. 7A-7B, the MEMS structure is similar to the MEMS structure in FIGS. 6A-6B except the backplate structure 206 in detail. The backplate structure 206 has a dielectric layer 240 over the cavity 202 of the substrate 200, as a base to provide the mechanical supporting strength. An electrode layer 242*a* in two regions and an electrode layer 242*b* are formed on the dielectric layer 240. The two regions of the electrode layer 242*a* are corresponding to the two regions of the first diaphragm regions 224*a*. The electrode layer 242*b* is corresponding to the second diaphragm region 224*b* of the diaphragm 224. As also noted, the two regions of the electrode layer 242*a* are directly connected at the side in the example. So in the example, the two regions of the electrode layer 242*a* are at the same operation voltage and electrically separated from the electrode layer 242*b*. The electrode layer 242*a* with the corresponding portion of the dielectric layer 240 can be generally referred as the first backplate. The electrode layer 242*b* with the corresponding portion of the dielectric layer 240 can be generally referred as the second backplate.

Figure 8A:
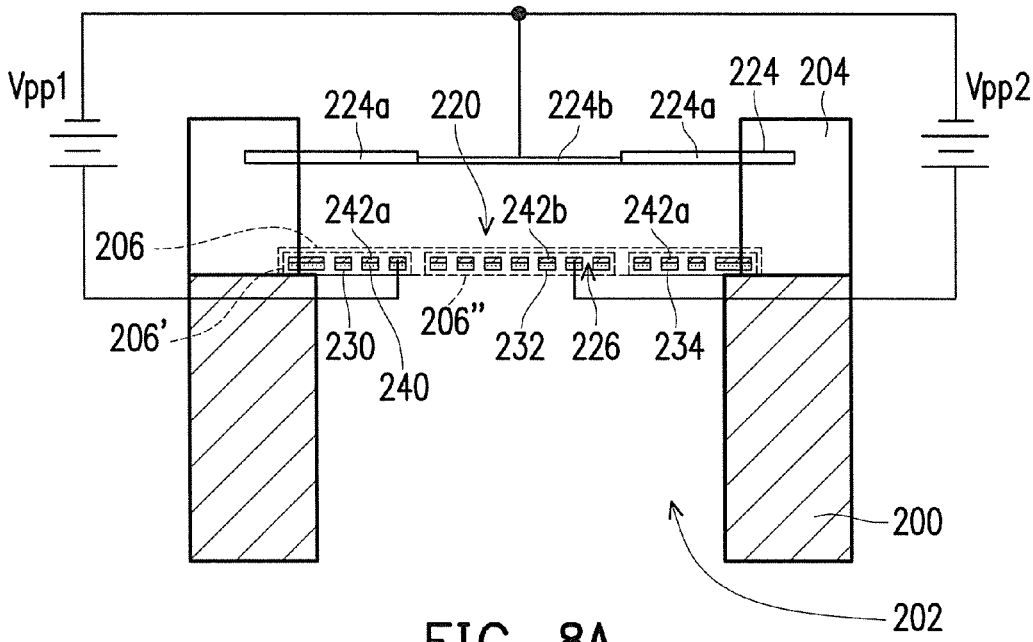
FIG. 8A-8B are cross-sectional view and top perspective view of a MEMS device, according to an embodiment of the invention.
Figure 8B:
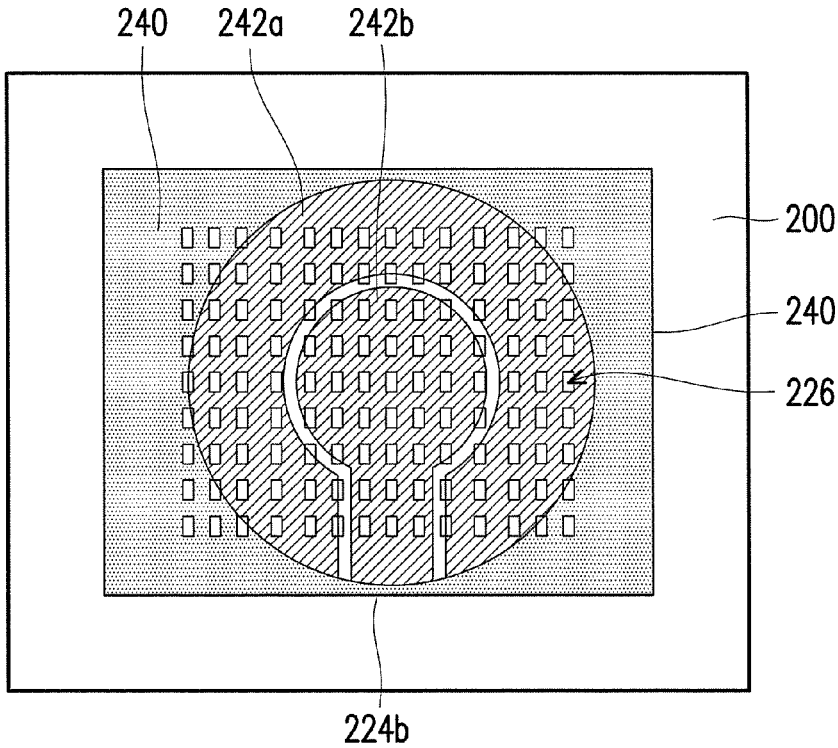

Further in alternative embodiment, FIG. 8A-8B are cross-sectional view and top perspective view of a MEMS device, according to an embodiment of the invention. In FIGS. 8A-8B, the shape of the diaphragm 224 is disk-like shape in the example. Taking the aspect in FIGS. 7A-7B, the first diaphragm region 224*a* of the diaphragm 224, as a peripheral region, surrounds the second diaphragm region 224*b*, as the central electrode region in disk-like shape. In addition, the second diaphragm region 224*b* may be higher in elastic constant than the first diaphragm region 224*a*. In other words, the central region of the second diaphragm region 224*b* is a region having a center of the diaphragm 224, and the peripheral region surrounds the central region.

For the backplate structure 206, the backplate structure 206 can be modified based on the structure shown in FIGS. 6A-6B with understanding by the one with skilled in the art. However, the embodiment in FIG. 8A-8B is based on the structure in FIGS. 7A-7B about using the common dielectric layer for providing supporting strength. In the example of FIGS. 8A-8B, the backplate structure 206 includes the dielectric layer 240 as the common dielectric layer, disposed over the substrate 200 above the cavity 202, in which the venting holes 226 are used to connect the cavity 202 and the chamber 220. The second electrode layer 242*b*, serving as the central electrode layer, is disposed on the dielectric layer 240 as a part of the first backplate, corresponding to the second diaphragm region 224*b* of the diaphragm 224. The first electrode layer

242*a*, as a peripheral electrode layer, is disposed on the dielectric layer 240 as a part of the second backplate, corresponding to the first diaphragm region 224*a* of the diaphragm 224.

It can be noted that the first electrode layer 242*a* surrounds the second electrode layer 242*b* but is electric separated. In order to leading out the connection terminal for applying the voltage for the second electrode layer 242*b*, the first electrode layer 242*a* may have a gap for letting an connection terminal of the second electrode layer 242*b* protrude out. However, the manner in the embodiment is not the only option.

Figure 9A:
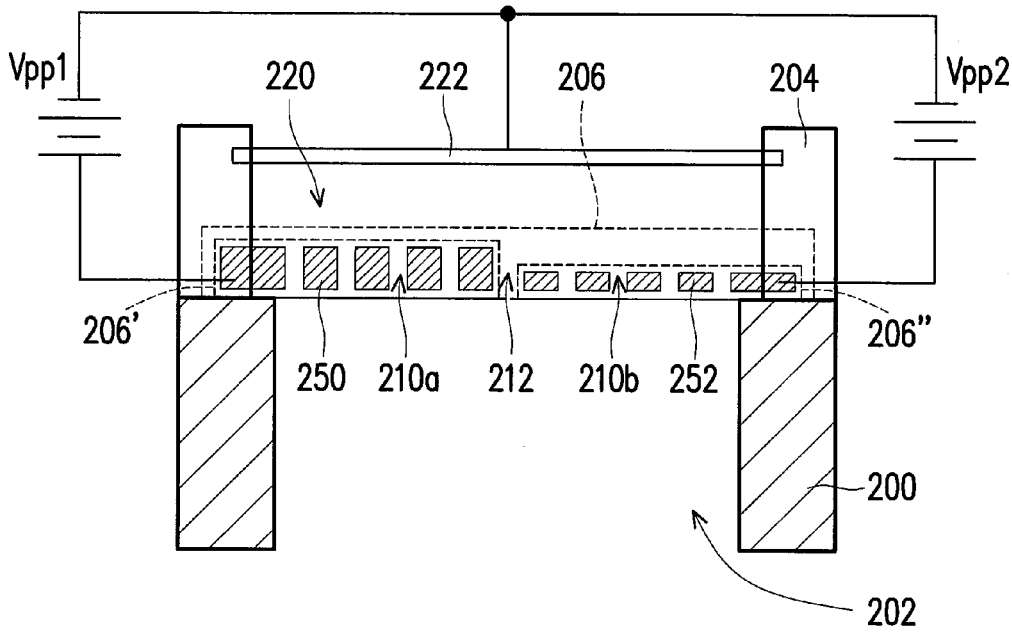
FIG. 9A-9B are cross-sectional view and top perspective view of a MEMS device, according to an embodiment of the invention.
Figure 9B:
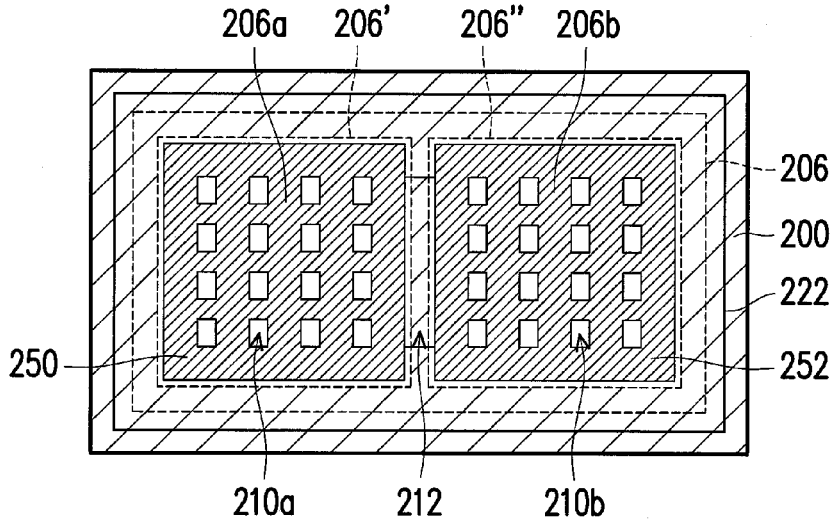

Further, FIGS. 9A-9B are cross-sectional view and top perspective view of a MEMS device, according to an embodiment of the invention. In FIGS. 9A-9B, taking the structure similar to FIGS. 3A-3B as an example, the first backplate 250, replacing the first backplate 206*a* in FIGS. 3A-3B, is now thicker than the second backplate 252, replacing the second backplate 206*b* in FIGS. 3A-3B. Because the different thickness, the distance between the diaphragm 222 and the first backplate 206*a* is D1 and the distance between the diaphragm 222 and the second backplate 206*b* is D2, in which D1<D2. Based on Eq. (1) and Eq. (2), the parameters D1 and D2 are also the parameters to change the capacitance, resulting in different sensitivity.

The aspect in FIGS. 9A-9B is to disclose the control of the distances for D1 and D2. The same mechanism can applied to other embodiments of the disclosures. For example, the embodiment in FIGS. 9A-9B can be modified according to FIGS. 4A-4B to change the backplate structure, or can be applied to the embodiment in FIG. 5A-8B. In other words, the embodiments provided in the disclosure may be properly combined into other embodiments. The disclosure does not provide all possible embodiments.

Further, in the foregoing embodiments, the diaphragm is disposed over the substrate higher than the backplate structure. Taking FIGS. 3A-3B as the example, the backplate structure 206 is formed on the substrate 200 and the diaphragm 222 is formed over the backplate structure 206. However, the backplate structure 206 and the diaphragm 222 in structure can be reversed in the foregoing embodiments.

Figure 10A:
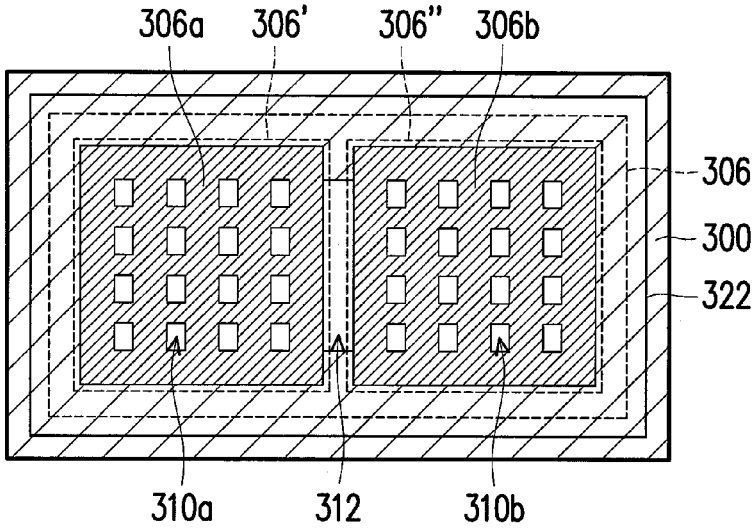
FIG. 10A-10B are top perspective view and cross-sectional view of a MEMS device, according to an embodiment of the invention.
Figure 10B:
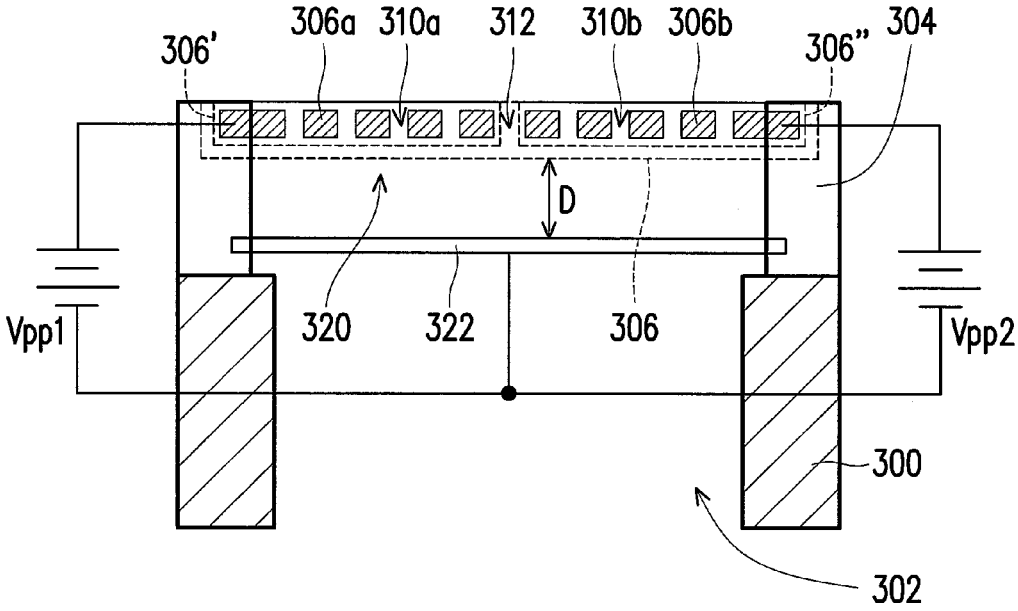

In an example, FIGS. 10A-10B are top perspective view and cross-sectional view of a MEMS device, according to an embodiment of the invention. In FIG. 10A and FIG. 10B, the substrate 300 has the cavity 302. A backplate structure 306 is formed with the dielectric layer 304 over the first side of the substrate 300. The diaphragm 322 is also formed with the dielectric layer 304 over the substrate 300, but exposed by the cavity 302. The backplate structure 306 includes at least a first backplate 306*a* included in a first electrode unit 306' and a second backplate 306*b* included in a second backplate unit 306".

The first backplate 306*a* and the second backplate 306*b* are electric disconnected, such as separation by a gap 312. Each of the first backplate 306*a* and the second backplate 306*b* respectively has venting holes 310*a*, 310*b* to connect the cavity 302 and the chamber 320. The venting holes 310*a* are included in the first backplate 306*a* and the venting holes 310*b* are included in the second backplate 306*b*. In this example, the first backplate 306*a* and the second backplate 306*b* are conductive, such as the polysilicon layer, so the electric disconnection is necessary to form separate capacitors. The diaphragm 322 is disposed under the backplate structure 306 by a distance D, so as to form a chamber 320 between the backplate structure 306 and the diaphragm 322. A periphery of the diaphragm 322 is embedded in the dielectric layer 304, as an example. The diaphragm 322 is conductive and serves as a common electrode in the embodiment. The first backplate 306*a* of the first electrode unit 306' and the second backplate 306*b* of the second electrode unit 306" respectively sever as two electrodes in conjugation with the diaphragm 322, as a common electrode, to form separate two capacitors.

As disclosed in FIGS. 10A-10B, the diaphragm 322 is under the backplate structure 306 and is exposed by the cavity 302. This change can be applied to other foregoing embodiments.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A micro electro-mechanical system (MEMS) microphone device, comprising:

a substrate, having a first side and a second side, wherein a cavity is formed at the second side;

a backplate structure, formed over the first side of the substrate, wherein the backplate structure includes at least a first backplate and a second backplate, wherein the first backplate and the second backplate are electric disconnected and have venting holes;

a diaphragm, formed over the first side of the substrate against the backplate structure by a distance, so as to form a chamber between the backplate structure and the diaphragm, wherein the diaphragm serves as a common electrode, wherein the first backplate and the second backplate respectively serve as a first electrode unit and a second electrode unit in conjugation with the diaphragm to form separate two capacitors, the two capacitors are exposed by the cavity.

2. The MEMS microphone device of claim 1, wherein the backplate structure is exposed by the cavity and the chamber is connected to the cavity via the venting holes.

3. The MEMS microphone device of claim 1, wherein the diaphragm is exposed by the cavity and the chamber is connected to outside via the vent holes.

4. The MEMS microphone device of claim 1, further comprise a dielectric layer disposed on the first side of the substrate at a periphery of the cavity, wherein the backplate and diaphragm are secured to the dielectric layer over the first side of the substrate.

5. The MEMS microphone device of claim 1, wherein the first backplate and the second backplate are same in thickness, so a distance between the first backplate and the diaphragm is equal to a distance between the second backplate and the diaphragm.

6. The MEMS microphone device of claim 1, wherein the first back plate and the second backplate are different in thickness, so a distance between the first backplate and the diaphragm is different to a distance between the second backplate and the diaphragm.

7. The MEMS microphone device of claim 1, wherein the first backplate and the second backplate are conductive and disconnected in structure.

8. The MEMS microphone device of claim 1, wherein the backplate structure comprises:

a common dielectric layer, disposed on the first side of the substrate;

a first electrode layer, disposed on the common dielectric layer as a part of the first backplate; and a second electrode layer, disposed on the common dielectric layer as a part of the second backplate, wherein the first electrode layer and the second electrode layer are disconnected in structure.

9. The MEMS microphone device of claim 1, wherein the diaphragm has at a central region corresponding to the first backplate and a peripheral region corresponding to the second backplate, the central region have different elastic constant from the peripheral region, so as to have different sensitivities.

10. The MEMS microphone device of claim 9, wherein the diaphragm is a disk-like shape, and the central region is a region having a center of the diaphragm, the peripheral region surrounds the central region.

11. The MEMS microphone device of claim 10, wherein the first backplate and the second backplate are conductive, and the first backplate has a disk-like structure surrounded by the second backplate.

12. The MEMS microphone device of claim 10, wherein the backplate structure comprises:

a common dielectric layer, disposed on the first side of the substrate;

a central electrode layer, disposed on the common dielectric layer as a part of the first backplate, corresponding to the central region of the diaphragm; and a peripheral electrode layer, disposed on the common dielectric layer as a part of the second backplate, corresponding to the peripheral region of the diaphragm, wherein the central electrode layer and the peripheral electrode layer are disconnected in structure.

13. The MEMS microphone device of claim 9, wherein the central region of the diaphragm in elastic constant is different from the peripheral region of the diaphragm.

14. The MEMS microphone device of claim 1, wherein the backplate structure does not include a part of the substrate.

15. The MEMS microphone device of claim 1, wherein the backplate structure include a part of the substrate at the first side over the cavity.

16. A micro electro-mechanical system (MEMS) circuit, comprising:

a MEMS device as recited in claim 1;

a first voltage source, coupled to the first electrode unit of the first backplate in the MEMS device;

a second voltage source, coupled to the second electrode unit of the second backplate in the MEMS device; and an amplifying circuit, to amplify a first sensing signal at the first electrode unit and a second sensing signal at the second electrode unit.

17. The MEMS circuit of claim 16, wherein the amplifying circuit comprises:

a first operational amplifier, coupled to the first electrode unit to amplify the first sensing signal; and a second operational amplifier, coupled to the second electrode unit to amplify the second sensing signal, wherein the first operation amplifier and the second operation amplifier have same amplification gain or different amplification gain.

18. The MEMS circuit of claim 16, wherein the amplifying circuit comprises:

a multiplexer, receiving a first sensing signal from the first electrode unit and a second sensing signal from the second electrode unit, and select one of the first sensing signal and the second sensing signal as an output signal, according to a selection signal; and an operational amplifier, amplifying the output signal of the multiplexer.

19. A micro electro-mechanical system (MEMS) microphone device, comprising:

a backplate structure, wherein the backplate structure includes at least a first backplate and a second backplate, wherein the first backplate and the second backplate are electric disconnected and have venting holes;

a diaphragm, formed over the backplate structure by a distance, so as to form a chamber between the backplate structure and the diaphragm and the chamber is connected to outside via the vent holes, wherein the diaphragm serves as a common electrode, wherein the first backplate and the second backplate respectively serve as a first electrode unit and a second electrode unit in conjugation with the diaphragm to form separate two capacitors.

20. A micro electro-mechanical system (MEMS) circuit, comprising:

a MEMS device as recited in claim 19;

a first voltage source, coupled to the first electrode unit of the first backplate in the MEMS device;

a second voltage source, coupled to the second electrode unit of the second backplate in the MEMS device; and an amplifying circuit, to amplify a first sensing signal at the first electrode unit and a second sensing signal at the second electrode unit.

* * * * *